US007297046B2

(12) United States Patent
Mavro-Michaelis

(10) Patent No.: US 7,297,046 B2
(45) Date of Patent: Nov. 20, 2007

(54) CONSTANT SPINDLE POWER GRINDING METHOD

(76) Inventor: Daniel Andrew Mavro-Michaelis, 8 Wigeon Approach, Morley, Leeds LS27 8GN (GB)

( * ) Notice: Subject to any disclaimer, the term of this patent is extended or adjusted under 35 U.S.C. 154(b) by 231 days.

(21) Appl. No.: 10/936,167

(22) Filed: Sep. 8, 2004

(65) Prior Publication Data

US 2005/0026548 A1 Feb. 3, 2005

Related U.S. Application Data

(62) Division of application No. 10/111,642, filed as application No. PCT/GB00/04136 on Oct. 26, 2000, now Pat. No. 6,808,438.

(30) Foreign Application Priority Data

Oct. 27, 1999 (GB) ..... 9925367.6
Oct. 28, 1999 (GB) ..... 9925487.2

(51) Int. Cl.
*B24B 49/00* (2006.01)

(52) U.S. Cl. ..... 451/5; 451/11; 451/57; 451/62

(58) Field of Classification Search ..... 451/5, 451/11, 57, 62
See application file for complete search history.

(56) References Cited

U.S. PATENT DOCUMENTS 2,209,538 A * 7/1940 Rabe ..... 451/62
2,898,707 A * 8/1959 Rickenmann ..... 451/219
4,299,061 A 11/1981 Parnum et al.
4,343,114 A 8/1982 Tourasse et al.
4,400,781 A 8/1983 Hotta et al.
4,527,356 A 7/1985 Ozone et al.
4,589,230 A * 5/1986 Yonemura et al. ..... 451/219
4,747,236 A 5/1988 Wedeniwski
4,848,038 A 7/1989 Maruyama et al.
4,885,874 A 12/1989 Wedeniwski
4,905,418 A * 3/1990 Wedeniwski ..... 451/5
4,942,695 A 7/1990 Wedeniwski
5,251,405 A 10/1993 Clauss et al.

(Continued)

FOREIGN PATENT DOCUMENTS

EP 0839604 5/1998

(Continued)

*Primary Examiner*—M. Rachuba
(74) *Attorney, Agent, or Firm*—Reising, Ethington, Barnes, Kisselle, P.C.

(57) ABSTRACT

The depth of cut and the headstock velocity of a grinding machine are controlled during the last rotation of finish grinding to maintain a substantially constant load on the grinding wheel spindle drive motor. The depth of cut is kept constant and the component speed of rotation is altered in order to maintain the constant power requirement. If the component profile alters the spindle loading during a single revolution, the component speed is altered from one point to another during each revolution so as to maintain the constant load. Headstock acceleration, deceleration, and velocity are controlled to take into account any variation in contact length between the wheel and component during the rotation of the latter, so that although the metal removal rate may vary slightly around the circumference of the component the power demand on the spindle motor is maintained substantially constant during the whole of the grinding of the component.

14 Claims, 4 Drawing Sheets

U.S. PATENT DOCUMENTS

| | | | | | |
|---|---|---|---|---|---|
| 5,259,150 | A | | 11/1993 | Himmelsbach | |
| 5,355,633 | A | | 10/1994 | Ishikawa et al. | |
| 5,392,566 | A | | 2/1995 | Wedeniwski | |
| 5,453,037 | A | | 9/1995 | Lehmann | |
| 5,746,643 | A | * | 5/1998 | Terasaki et al. | 451/5 |
| 5,895,311 | A | * | 4/1999 | Shiotani et al. | 451/5 |
| 5,899,797 | A | | 5/1999 | Junker | |
| 5,919,081 | A | * | 7/1999 | Hykes et al. | 451/11 |
| 5,975,995 | A | | 11/1999 | Hykes et al. | |
| 6,200,200 | B1 | | 3/2001 | Himmelsbach | |

FOREIGN PATENT DOCUMENTS

| | | |
|---|---|---|
| WO | WO92/07690 | 5/1992 |
| WO | WO 9603257 A | 2/1996 |
| WO | WO 0066323 | 11/2000 |

* cited by examiner

CONSTANT SPINDLE POWER GRINDING METHOD

REFERENCE TO RELATED APPLICATION

This is a divisional application of case Ser. No. 10/111,642 filed Apr. 26, 2002 now U.S. Pat. No. 6,808,438 which is a National Stage entry of PCT/GB00/04136, filed Oct. 26, 2000. This application claims priority from GB 9925487.2, filed Oct. 28, 1999, and GB 9925367.6, filed Oct. 27, 1999.

FIELD OF THE INVENTION

This invention concerns the grinding of workpieces and improvements which enable grind times to be reduced, relatively uniform wheel wear and improved surface finish on components such as cams. The invention is of particular application to the grinding of non cylindrical workpieces such as cams that have concave depressions in the flanks, which are typically referred to as re-entrant cams

BACKGROUND OF THE INVENTION

Traditionally a cam lobe grind has been split into several separate increments typically five increments. Thus if it was necessary to remove a total of 2 mm depth of stock on the radius, the depth of material removed during each of the increments typically would be 0.75 mm in the first two increments, 0.4 m in the third increments, 0.08 mm in the fourth, and 0.02 mm in the last increment.

Usually the process would culminate in a spark-out turn with no feed applied so that during the spark-out process, any load stored in the wheel and component was removed and an acceptable finish and form is achieved on the component.

Sometimes additional rough and finish increments were employed, thereby increasing the number of increments.

During grinding, the component is rotated about an axis and if the component is to be cylindrical, the grinding wheel is advanced and held at a constant position relative to that axis for each of the increments so that a cylindrical component results. The workpiece is rotated via the headstock and the rotational speed of the workpiece (often referred to as the headstock velocity), can be of the order of 100 rpm where the component which is being ground is cylindrical. Where a non-cylindrical component is involved and the wheel has to advance and retract during each rotation of the workpiece, so as to grind the non-circular profile, the headstock velocity has been rather less than that used when grinding cylindrical components. Thus 20 to 60 rpm has been typical of the headstock velocity when grinding non-cylindrical portions of cams.

Generally it has been perceived that any reduction in headstock velocity increases the grinding time, and because of commercial considerations, any such increase is unattractive.

The problem is particularly noticeable when re-entrant cams are to be ground in this way. In the re-entrant region, the contact length between the wheel and the workpiece increases possibly tenfold (especially in the case of a wheel having a radius the same, or just less than, the desired concavity), relative to the contact length between the wheel and the workpiece around the cam nose and base circle. A typical velocity profile when grinding a re-entrant cam with a shallow re-entrancy will have been 60 rpm around the nose of the cam, 40 rpm along the flanks of the cam containing the re-entrant regions, and 100 rpm around the base circle of the cam. The headstock would be accelerated or decelerated between these constant speeds within the dynamic capabilities of the machine (c & x axes), and usually constant acceleration/deceleration has been employed.

The power demand on the spindle motor driving the grinding wheel is dictated in part by the material removal rates i.e. the amount of material the wheel has to remove per unit time. The increased contact length in the re-entrant regions has tended to increase this and very high peak power requirements have been noted during the grinding of the concave regions of the flanks of re-entrant cams.

For any given motor, the peak power is determined by the manufacturer, and this has limited the cycle time for grinding particularly re-entrant cams, since it is important not to make demands on the motor greater than the peak power demand capability designed into the motor by the manufacturer.

Hitherto a reduction in cycle time has been achieved by increasing the workspeed used for each component revolution. This has resulted in chatter and burn marks, bumps and hollows in the finished surface of the cam which are unacceptable for camshafts to be used in modern high performance engines, where precision and accuracy is essential to achieve predicted combustion performance and engine efficiency.

The innovations described herein have a number of different objectives.

The first objective is to reduce the time to precision grind components such as cams especially re-entrant cams.

Another objective is to improve the surface finish of such ground components.

Another objective is to produce an acceptable surface finish with larger intervals between dressings.

Another objective is to equalise the wheel wear around the circumference of the grinding wheel.

Another objective is to improve the accessibility of coolant to the work region particularly when grinding re-entrant cams.

Another objective is to provide a design of grinding machine, which is capable of rough grinding and finish grinding a precision component such as a camshaft, in which the cam flanks have concave regions.

These and other objectives will be evident from the following description.

BRIEF SUMMARY OF THE INVENTION

According to the present invention, there is provided a method of grinding a component which is rotated by a headstock during grinding, comprising the steps of removing metal in a conventional way until shortly before finish size is achieved, thereafter rotating the component through only one revolution during a finish grinding step, and controlling the depth of cut and the headstock velocity during that single rotation, so as to maintain a substantially constant load on the grinding wheel spindle drive motor.

The depth of cut and/or speed of rotation of the component during the one revolution may be adjusted to ensure that the demand on the spindle drive does not exceed the maximum rated power capability of the motor.

In order to maintain a constant power requirement for the spindle without exceeding the maximum power capability of the spindle motor, the component speed of rotation may be altered during the finish grind rotation.

When used to grind a component the profile of which will increase and decrease the loading on the spindle motor during a single revolution of the component, the speed of rotation of the component may be altered as between one point and another during the single revolution so as to maintain a substantially constant load on the spindle motor.

Preferably the instantaneous rotational speed of the component is varied so as to accommodate load variations due to component profile, such as non-cylindrical features of a component.

The headstock speed of rotation may be varied to take account of any variation in contact length between the wheel and the workpiece such as where the component is non-circular or where parts of the surface being ground are to be finished with a concave profile as opposed to a flat or convex profile.

When using a CBN wheel in the range 80-120 mm diameter for grinding a steel component, and with 17.5 kw of power available for driving the grinding wheel, wheelfeed has been adjusted to achieve a depth of cut during the single finish grinding step in the range 0.25 to 0.5 mm, and the headstock drive has been adjusted to rotate the component at speeds in the range 2-20 rpm.

The invention also provides a method of grinding a component which is rotated by a headstock during grinding to finish size, wherein the headstock velocity is linked to the power capabilities of the grinding wheel spindle drive, and a significant grinding force is maintained between the wheel and the component up to the end of the grinding process including during finish grinding, thereby to achieve a significant depth of cut even during the finish grinding step, for the purpose of reducing chatter and grind marks on the final finished surface and to achieve a short grind time.

The invention also lies in method of grinding a component which is rotated by a headstock during grinding wherein a substantially constant power demand on the spindle drive is achieved by controlling the headstock velocity during grinding, especially during final finish grinding, so as to accelerate and decelerate the rotational speed of the component during grinding whilst maintaining a significant depth of cut, so as to present a substantially constant loading on the spindle motor, which is very close to the maximum power rating of the motor, for the purpose of achieving substantially even wear around the circumference of the grinding wheel, and achieving a short grind time.

In such a method of grinding wherein the component is non-cylindrical, the headstock speed of rotation is preferably altered as the component rotates to achieve a substantially constant load on the spindle drive motor.

The invention also lies in a method of achieving substantially constant wear around the circumference of a grinding wheel when grinding a component which itself is rotated by a headstock and reducing grind and chatter marks on the component being ground, wherein a computer is programmed to control headstock acceleration and deceleration and headstock velocity during the rotation of the component and to take into account of any variation in contact length between the wheel and component during the rotation of the latter, so that although the metal removal rate may vary slightly around the circumference of the component, the power demand on the spindle motor is maintained substantially constant during the whole of the grinding of the component.

In any method according to the invention, the grinding of the component is preferably performed using a small diameter wheel, both for rough grinding and for finish grinding, so as to reduce the length of contact between the grinding wheel and the component, for the purpose of allowing coolant fluid good access to the region in which grinding is occurring at all stages of the grinding process, so as to minimise surface damage which can otherwise occur if coolant fluid is obscured from the component.

Two small wheels may be mounted on the same machine, and one is used to rough grind and the other to finish grind the component, without the need to demount the latter.

Alternatively a single wheel may be employed and a wheel selected which is capable of rough grinding and finish grinding the component.

Preferably a CBN wheel is employed in any method of the invention.

The invention also provides a method of computer-controlled grinding of a component to produce a finish-ground article, comprising a first stage in which the wheel grinds the component to remove a relatively large depth of material whilst the component is rotated by a headstock around its axis, with computer control of the headstock velocity at all times during each rotation of the component and with adjustment of the headstock velocity to accommodate any variation in contact length in the region around the component so as to maintain a substantially constant power demand on the grinding wheel spindle motor which is equal to or just below the maximum constant power rating of the motor, so that the time for grinding the first stage is reduced to the shortest period linked to the power available, and a second stage in which the component is ground to finish size, with the grinding parameters and particularly wheelfeed and headstock velocity, being computer controlled so that power demand on the spindle motor is maintained constant at or near the constant power rating of the motor, at all points around the component during the said single revolution, during which the depth of cut is such as to leave the component ground to size.

The second stage is preferably arranged to occur when the depth of material left to be removed to achieve finish size, can be removed by one revolution of the component.

A grinding machine for performing any of the aforesaid methods typically includes a programmable computer-based control system for generating control signals for advancing and retracting the grinding wheel and controlling the acceleration and deceleration of the headstock drive and therefore the instantaneous rotational speed of the component.

The invention also lies in a computer program for controlling a computer based system which forms part of a grinding machine for performing any grinding process of the invention.

The invention also lies in a component when produced by any method of the invention.

The invention also lies in a grinding machine including a programmable computer based control system adapted to operate so as to perform any method of the invention.

The invention relies on the current state of the art grinding machine in which a grinding wheel mounted on a spindle driven by a motor can be advanced and retracted towards and away from a workpiece under programmable computer control. Rotational speed of the wheel is assumed to be high and constant, whereas the headstock velocity, which determines the rotational speed of the workpiece around its axis during the grinding process, can be controlled (again by programmable computer) so as to be capable of considerable adjustment during each revolution of the workpiece. The invention takes advantage of the highly precise control now available in such a state of the art grinding machine to decrease the cycle time, improve the dressing frequency, and wheel wear characteristics, especially when grinding non-cylindrical workpieces such as cams, particularly re-entrant cams.

A reduction in the finish grinding time of a cam is achieved by rotating the cam through only one revolution during the finish grinding process and controlling the depth of cut as well as the headstock velocity during that single revolution so as to maintain a substantially constant load on the spindle motor.

The advance of the wheelhead will determine the depth of cut and the rotational speed of the cam will be determined by the headstock drive.

In general the larger the depth of cut and the higher the workspeed, the higher is the spindle power requirement and the invention seeks to make a constant demand on the spindle motor which is just within the maximum rated power capability of the spindle motor.

In general it is desirable to maintain a constant depth of cut, and in order to maintain a constant power requirement for the spindle, the invention provides that the workpiece speed of rotation should be altered during the finish grind rotation to accommodate non-cylindrical features of a workpiece. In one example using a known diameter CBN wheel to grind a camshaft, a finish grind time of approximately 75% of that achieved using conventional grinding techniques can be obtained if the headstock velocity is varied between 2 and 20 rpm during the single finish grind revolution of the cam, with the lower speed used for grinding the flanks and the higher speed used during the grinding of the nose and base circle of the cam.

More particularly and in addition, the depth of cut has been significantly increased from that normally associated with the finish grinding step, and depths in the range of 0.25 to 0.5 mm have been achieved during the single finish grinding step, using grinding wheels having a diameter in the range 80 to 120 mm with 17.5 kw of available grind power, when grinding cams on a camshaft.

The surprising result has been firstly a very acceptable surface finish without the bumps, humps or hollows typically found around the ground surface of such a component when higher headstock velocities and smaller metal removal rates have been employed, despite the relatively large volume of metal which has been removed during this single revolution and secondly the lack of thermal damage to the cam lobe surface, despite the relatively large volume of metal which has been removed during this single revolution. Conventional grinding methods have tended to burn the surface of the cam lobe when deep cuts have been taken.

In order not to leave an unwanted bump or hump at the point where the grinding wheel first engages the component at the beginning of the single revolution finish grind, the headstock drive is preferably programmed to generate a slight overrun so that the wheel remains in contact with the workpiece during slightly more than 360° of rotation of the latter. The slight overrun ensures that any high point is removed in the same way as a spark-out cycle has been used to remove any such grind inaccuracies in previous grinding processes. The difference is that instead of rotating the component through one or more revolutions to achieve spark-out, the spark-out process is limited to only that part of the surface of the cam which needs this treatment.

A finish grinding step for producing a high precision surface in a ground component such as a cam involves the application of a greater and constant force between the grinding wheel and the component during a single revolution in which finish grinding takes place, than has hitherto been considered to be appropriate.

The increased grinding force is required to achieve the larger depth of cut, which in turn reduces the cycle time, since only one revolution plus a slight overrun is required to achieve a finished component without significant spark-out time, but as a consequence the increased grinding force between the wheel and the workpiece has been found to produce a smoother finished surface than when previous grinding processes have been used involving a conventional spark-out step.

The invention also lies in a method of controlling the grinding of a component, particularly a non-cylindrical component such as a re-entrant cam, so as to reduce chatter and grind marks on the final finished surface by maintaining a significant grinding force between the wheel and the component up to the end of the grinding process including the finish grinding step, thereby to achieve a significant depth of cut even during the final finish grinding step by linking the headstock velocity to the power capabilities of the spindle drive.

A substantially constant power demand on the spindle drive can be achieved by controlling the headstock velocity during the finish grinding so as to accelerate and decelerate the workpiece speed of rotation during that cycle, so as to present a substantially constant loading on the spindle motor whilst maintaining the said significant depth of cut.

By ensuring the load on the motor is substantially constant and as close as possible to its maximum power rating during the whole of the rotation, power surges that cause decelerations should not occur. As a result even wheel wear should result.

In particular however, an additional element of control may be included to take account of the varying contact length between the wheel and the workpiece where the component is non-circular and particularly where parts of the surface being ground are to be finished with a concave profile as opposed to a flat or convex profile. Thus the headstock velocity is controlled to take account of any increase and decease in contact length between wheel and workpiece such as can occur in the case of a re-entrant cam between concave regions in the flanks and convex regions around the nose and base circle of the cam.

The invention also lies in controlling a grinding machine as aforesaid for the purpose of achieving substantially constant wheel wear during the grinding of non-cylindrical workpieces.

In particular by controlling headstock acceleration and deceleration and headstock velocity during the rotation of a non-cylindrical workpiece, and taking account of the varying contact length between the wheel and workpiece during the rotation of the latter, so that power demand on the spindle motor is maintained substantially constant, substantially constant wheel wear results although the metal removal rate may vary slightly around the circumference of the workpiece during rotation thereof. Since the wheel is rotating at many times the speed of rotation of the workpiece, it has not been thought important to control the grinding process for this purpose. However, by controlling the grinding machine parameters in a manner to maintain constant spindle power during the grinding process of such workpieces, wheel wear has been found to be generally uniform despite varying metal removal rate, and there is less tendency for uneven wheel wear to occur such as has been observed in the past.

This reduces the down time required for dressing the wheel and again improves the efficiency of the overall process.

Conventionally, larger grinding wheels have been used for rough grinding and smaller wheels for finish grinding, particularly where the large wheel has a radius which is too great to enable the wheel to grind a concave region in the flank of a re-entrant cam. Proposals have been put forward to minimise the wear of the smaller wheel by utilising the large wheel to grind as much of the basic shape of the cam as possible, including part of the concave regions along the flanks of the cam, and then use the smaller wheel to simply remove the material left in the concave regions, and then finish grind the cam in a typical spark-out mode.

When utilising such a process it has been observed that a large wheel obscures a part of the concave surface it is generating, from coolant fluid, so that surface damage can occur during the rough grinding of the concavity. This has created problems when trying to achieve a high quality surface finish in the concavity when subsequently using a smaller wheel to finish grind the component.

When grinding a component so as to have concave regions, grinding is preferably performed using two small diameter wheels, typically both the same diameter, one for rough grinding and the other for finish grinding, preferably on the same machine, so that the component can be engaged by the rough grinding wheel at one stage during the grinding process and the other grinding wheel during the finish grinding process, so as to reduce the length of contact between the grinding wheel and the component, particularly in the concave regions of the flanks so that coolant fluid has good access to the region in which the grinding is occurring at all stages of the grinding process so as to minimise the surface damage which can otherwise occur if coolant fluid is obscured.

As employed herein the term "small" as applied to the diameter of the grinding wheels means 200 mm diameter or less, typically 120 mm diameter. 80 mm and 50 mm wheels have been used to good effect.

It has become conventional to employ CBN wheels for grinding components such as camshafts, but since wheels formed from such material are relatively hard, wheel chatter can be a significant problem and the present invention reduces wheel chatter when CBN wheels are employed by ensuring a relatively high grinding force throughout the grinding of the components, as compared with conventional processes in which relatively small depths of cut have characterised the final stages of the grind, so that virtually no force between wheel and component has existed, so that any out of roundness or surface irregularity of the component can set up wheel bounce and chatter.

Results to date indicate that depth of cut should be at least twice and typically 4 to 5 times what has hitherto been considered appropriate for finish grinding, and therefore the force between wheel and component as proposed by the invention is increased accordingly.

In a two-spindle machine, a preferred arrangement is for the two spindles to be mounted vertically one above the other at the outboard end of a pivoting frame which is pivotable about a horizontal axis relative to a sliding wheelhead. By pivoting the arm up or down so that one or the other of the spindles will become aligned with the workpiece axis, and by advancing the wheelhead to which the frame is pivoted relative to the workpiece axis, so a grinding wheel attached to the spindle can be advanced towards and retracted away from the workpiece.

The arm may be raised and lowered using pneumatic or hydraulic drives, or solenoid or electric motor drive.

Where one of the wheels is to be used for rough grinding and the other for finish grinding, it is preferred that the rough grinding wheel is mounted on the upper spindle since such an arrangement presents a stiffer structure in its lowered condition. The stiffer configuration tends to resist the increased forces associated with rough grinding.

Any method described herein may of course be applied to the grinding of any workpiece whether cylindrical or non-cylindrical and may also be applied to the grinding processes which precede the finish grinding step. Thus a typical multi-increment grinding process can be reduced to a two increment process in which (a) the first increment grinds the component to remove a large quantity of material whilst the component is rotated at a relatively slow speed around its axis, with computer control of the headstock velocity at all times during each rotation and with adjustment of the headstock velocity to accommodate increased contact length in any concave regions of a non cylindrical component so as to maintain a substantially constant power demand on the spindle motor which is equal to or just less than the constant power rating of the motor, so that the time for grinding the first increment is reduced to the shortest period linked to the power available, and (b) the second increment comprises finish grinding during a single revolution of the workpiece with the grinding parameters being controlled by the computer so that power demand on the spindle motor is similarly maintained constant at or near the constant power rating for the motor during the said single revolution and with headstock velocity also controlled by the computer so as to maintain the spindle power demand constant.

A grinding machine for performing the invention, preferably includes a programmable computer based control system for generating control signals for advancing and retracting the grinding wheel and controlling the acceleration and deceleration of the headstock drive and therefore the instantaneous rotational speed of the workpiece.

The invention also lies in a computer program for controlling a computer which itself forms part of a grinding machine as aforesaid for achieving each of the grinding processes described herein, in a component when produced by any method as aforesaid, and in a grinding machine including a programmable computer adapted to operate in the manner as described herein.

BRIEF DESCRIPTION OF THE SEVERAL VIEWS OF THE DRAWINGS

The invention will now be described by way of example with reference to the accompanying drawings, in which.

DESCRIPTION OF THE PREFERRED EMBODIMENT

Figure 1:
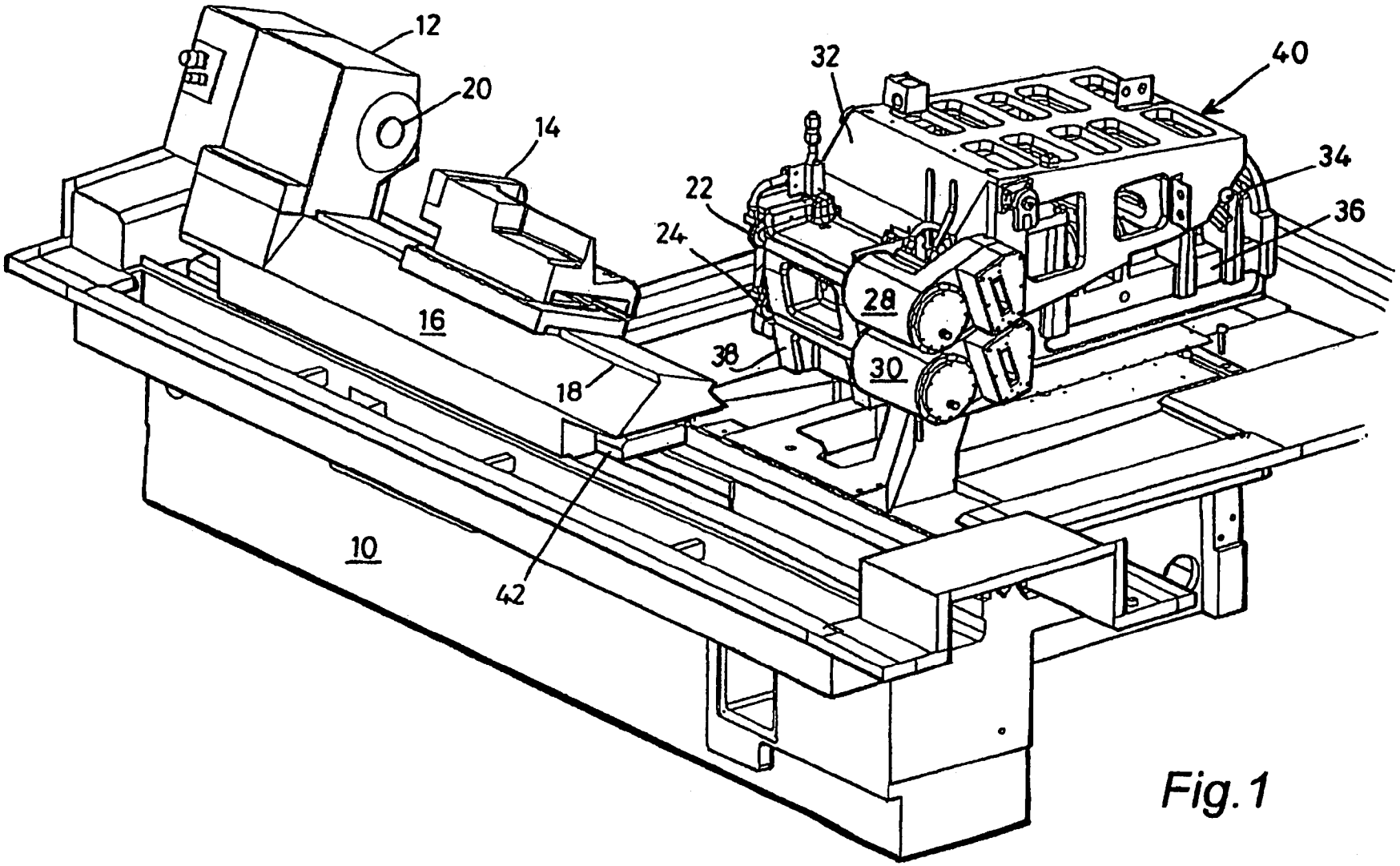
FIG. 1 is a perspective view of a twin wheel grinding machine.

In the drawings, the bed of the machine is denoted by reference numeral 10, the headstock assembly as 12 and the tailstock 14. The worktable 16 includes a slideway 18 along which the headstock 14 can move and be positioned and fixed therealong. The machine is intended to grind cams of camshafts for vehicle engines, and is especially suited to the grinding of cams having concave regions along their flanks.

A rotational drive (not shown) is contained within the housing of the headstock assembly 12 and a drive transmitting and camshaft mounting device 20 extends from the headstock assembly 12 to both support and rotate the camshaft. A further camshaft supporting device (not shown) extends towards the headstock from the tailstock 14.

Two grinding wheels 22 and 24 are carried at the outboard ends of the two spindles, neither of which is visible but which extend within a casting 26 from the left hand to the right hand thereof, where the spindles are attached to two electric motors at 28 and 30 respectively for rotating the central shafts of the spindles. This transmits drive to the wheels 22 and 24 mounted thereon.

The width of the casting 26 and therefore the length of the spindles is such that the motors 28 and 30 are located well to the right of the region containing the workpiece (not shown) and tailstock 14, so that as wheels 22 and 24 are advanced to engage cams along the length of the camshaft, so the motors do not interfere with the tailstock.

The casting 26 is an integral part of (or is attached to the forward end of) a larger casting 32 which is pivotally attached by means of a main bearing assembly (hidden from view but one end of which can be seen at 34) so that the casting 32 can pivot up and down relative to the axis of the main bearing 34, and therefore relative to a platform 36. The latter forms the base of the wheelhead assembly which is slidable orthogonally relative to the workpiece axis along a slideway, the front end of which is visible at 38. This comprises the stationary part of a linear motor (not shown) which preferably includes hydrostatic bearings to enable the massive assembly generally designated 40 to slide freely and with minimal friction and maximum stiffness along the slideway 38.

The latter is fixed to the main machine frame 10 as is the slideway 42 which extends at right angles thereto along which the worktable 16 can slide.

Drive means is provided for moving the worktable relative to the slide 42, but this drive is not visible in the drawings.

The grinding wheels are typically CBN wheels.

The machine is designed for use with small diameter grinding wheels equal to or less than 200 mm diameter. Tests have been performed using 100 mm and 80 mm wheels. Smaller wheels such as 50 mm wheels could also be used.

Figure 2:
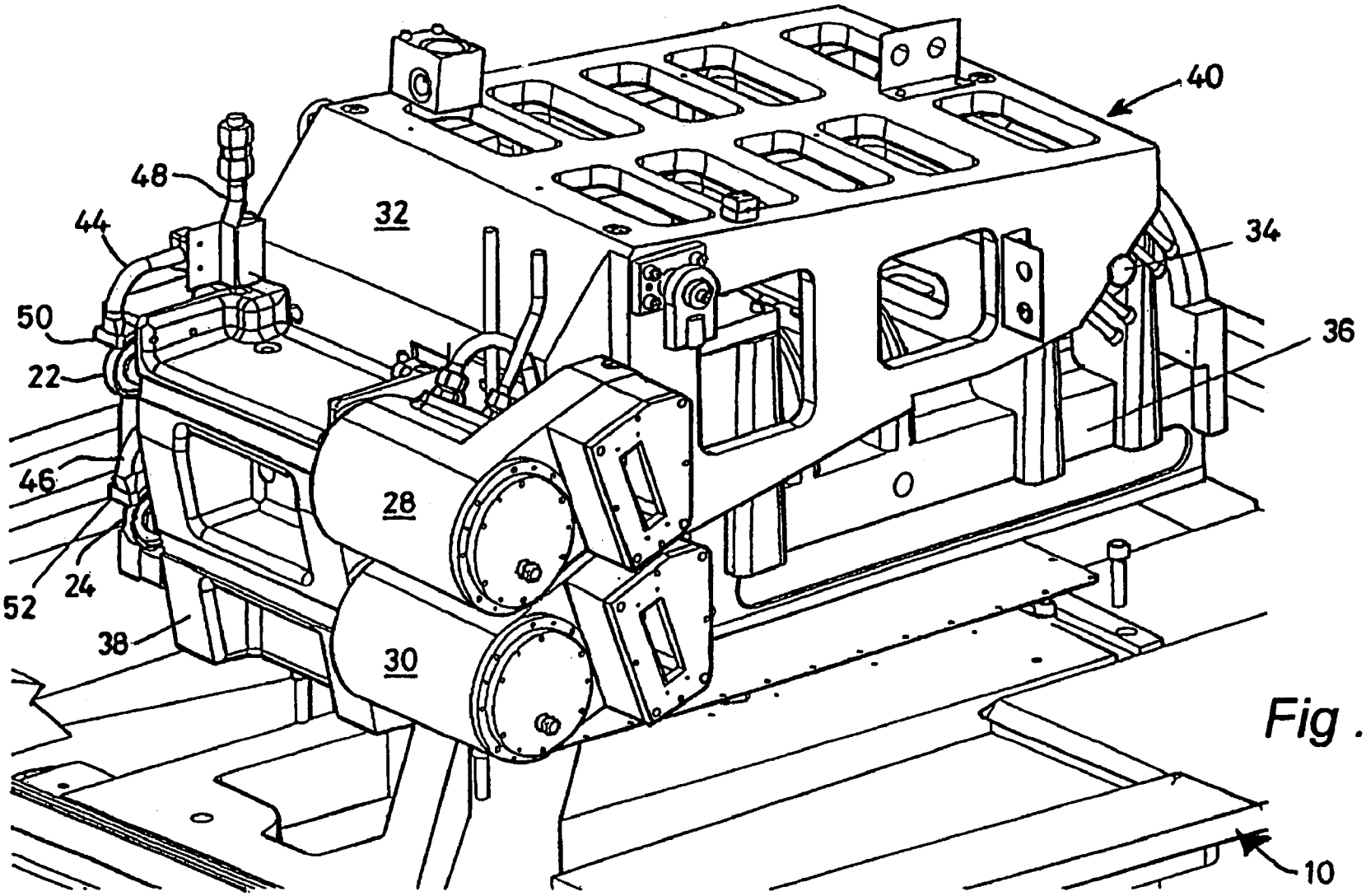
FIG. 2 is an enlarged view of part of the machine shown in FIG. 1.

As better seen in FIG. 2, coolant can be directed onto the grinding region between each wheel and a cam by means of pipework 44 and 46 respectively which extend from a manifold (nor shown) supplied with coolant fluid via a pipe 48 from a pump (not shown).

Valve means is provided within the manifold (not shown) to direct the coolant fluid either via pipe 44 to coolant outlet 50 or via pipe 46 to coolant outlet 52. The coolant outlet is selected depending on which wheel is being used at the time.

The valve means or the coolant supply pump or both are controlled so as to enable a trickle to flow from either outlet 50 or 52, during a final grinding step associated with the grinding of each of the cams.

A computer (not shown) is associated with the machine shown in FIGS. 1 and 2, and the signals from a tacho (not shown) associated with the headstock drive, from position sensors associated with the linear motions of the wheelhead assembly and of the worktable, enable the computer to generate the required control signals for controlling the feed rate, rotational speed of the workpiece and position of the worktable and if desired, the rotational speed of the grinding wheels, for the purposes herein described.

As indicated above, the machine shown in FIGS. 1 and 2 may be used to grind cams of camshafts, and is of particular use in grinding cams which are to have a slightly concave form along one or both of their flanks. The radius of curvature in such concave regions is typically of the order or 50 to 100 mm and, as is well known, it is impossible to grind out the concave curvature using the larger diameter wheels—(usually in excess of 300 mm in diameter), which conventionally have been employed for grinding components such as a camshafts and crankshafts. By using two similar, small diameter grinding wheels, and mounting them in the machine of FIGS. 1 and 2, not only the convex regions, but also any concave regions of the flanks (when needed), can be ground without demounting the workpiece. Furthermore, if appropriate grinding wheels are used (so that rough grinding and finish grinding can be performed by the same wheel), the grinding can be performed without even changing from one wheel to another.

Maintaining machine parameters so as to obtain a constant specific metal removal rate (SMRR) can produce unwanted power demand peaks when grinding, as the length of contact between the part and the wheel is not accounted for. The present invention (in which the machine parameters are controlled so as to ensure substantially constant power demand on the spindle drive (motor)), smoothes out the loads on the grinding wheel, resulting in even less chatter marks on the workpiece and further improving wheel wear rates.

The relationship between Specific Power P' (expressed in terms of Kw/mm of width of wheel or workpiece (whichever is the narrower)) and other machine parameters is given by the following expression:

$$P' = \text{Whl spd} * LOC * SMRR * Cr \quad \text{(A)}$$

Where P'=Specific Power (kw/mm of width)

Whl spd=wheel surface speed in mm/s

LOC=length of contact between component and wheel (mm)

SMRR=specific metal removal rate ($mm^3/mm \cdot s$)

Cr=a constant (determined by the chosen grinding wheel and workpiece)

In general these are known prior to grinding.

Thus Specific Power is the maximum motor power divided by the width of the region of the workpiece being ground, eg the width of a cam lobe (when grinding a camshaft, and where the wheel width is greater than or equal to the width of the region).

The wheel speed can be set prior to grinding. Usually 100 m/s surface speed.

The LOC between the component and the wheel can be determined by the wheel radius, component radius, and the depth of each cut—all of which are known.

Cr is a constant for any grinding wheel and workpiece material value is obtained from previous tests on similar materials using similar grinding wheels.

Thus the SMRR can be calculated using values for the other variables, and an appropriate Cr value, and using the SMRR value the headstock velocity can be calculated for each degree of rotation of the component (e.g. camshaft).

A computer program may be used to calculate the length of contact between the component and wheel, and to convert the SMRR figures into instantaneous headstock rpm figures.

Thus in the calculation of the Length of Contact (LOC), the information required to start with is:

Cam profile=lift per degree above base circle radius (units=mm)

Total stock (radially) to remove from the cam lobe (units=mm)

The increments the stock will be removed in (units=mm)

The grinding wheel diameter (units=mm)

and using the relevant algorithm from the following analysis, the Length of contact (LOC) can be computed in mm per degree of rotation of the cam lobe.

In the case of the conversion from specific metal removal rate to headstock rpm, the information at the start is:

Cam profile=lift per degree above base circle radius (units=nm)

Total stock (radially) to remove from the cam lobe (units=mm)

The increments the stock will be removed in (units=mm)

The required specific metal removal rate (units=$mm^3$/mm·s)

and using the relevant algorithm from the following analysis, the headstock speed for each degree of rotation of the cam lobe (in rpm) can be computed.

Figure 3:
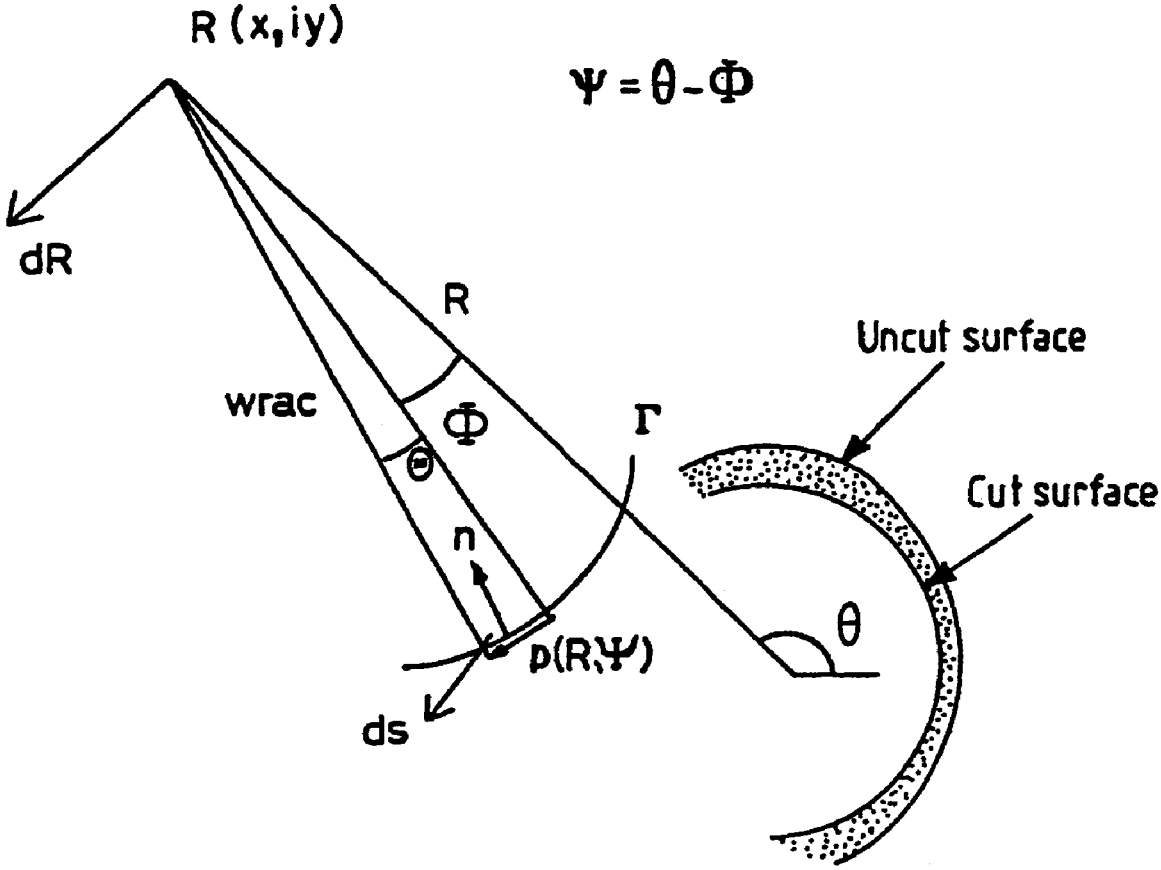
FIG. 3 depicts a grinding wheel and a cam that is to be ground.

The mathematical steps required to be performed by the computer program can best be understood by first referring to FIG. 3, in which:

Γ=wheel/work contact surface

R=complex location of wheel centre dR=vector wheel motion p=a point along Γ ds=motion of a point along Γ

θ=angle of wheel centre

Φ=angle between the tangency point on the cut surface and the line joining the wheel and part centre Θ=angle from tangency point along θ n=the unit normal on the wheel surface wrac=the wheel radius

In FIG. 3, the wheel centre rotates about the cam centre and the depth of material is constant. θ is measured counter-clockwise, Φ and Θ are measured clockwise. Using this convention, the cut (Γ) begins at θ-Φ and ends at θ-Φ-Θ; and Θ is the angle along the wheel/work surface.

If the specific metal removal rate is denoted by Q', then Q' can be computed using the equation (B), as derived using Formula 1 calculations as follows:

$$Q' \cdot dt = \int_{\Gamma} \overline{ds} \cdot \check{n}$$

$$\Gamma = wrac \cdot \Theta$$

$$d\Gamma = wrac \cdot d\Theta$$

$$\overline{R} = R \cdot [\cos(\theta + i) \cdot \sin(\theta)], \text{ where } i \to \sqrt{-1}$$

$$\overline{p} = \overline{R} - wrac \cdot [\cos(\Psi - \Theta) + i \cdot \sin(\Psi - \Theta)]$$

$$\overline{ds} = \frac{\partial p}{\partial R} \cdot dR + \frac{\partial p}{\partial \Psi} \cdot d\Psi \Rightarrow \overline{ds} = \overline{dR} - wrac \cdot [-\sin(\Psi - \Theta) + i \cdot \cos(\Psi - \Theta)] d\Psi$$

$$\check{n} = \cos(\Psi - \Theta) + i \cdot \sin(\Psi - \Theta)$$

$$\overline{ds} \cdot \check{n} = |ds| \cdot \cos(\angle \overline{ds} - \angle \check{n}) = \text{real}\{\overline{ds} \cdot \check{n}^*\}, \text{ where } * \to \text{complex conjugate}$$

$$\Rightarrow d\bar{s} \cdot \check{n} = \text{real}(d\bar{s}) \cdot \text{real}(\check{n}) + \text{imag}(d\bar{s}) \cdot \text{imag}(\check{n}) = [\text{real}(\overline{dR}) + wrac \cdot \sin(\Psi - \Theta) d\Psi] \cdot \cos(\Psi - \Theta) + [\text{imag}(d\overline{R}) - wrac \cdot \cos(\Psi - \Theta) d\Psi] \cdot \sin(\Psi - \Theta)$$

Figure 4:
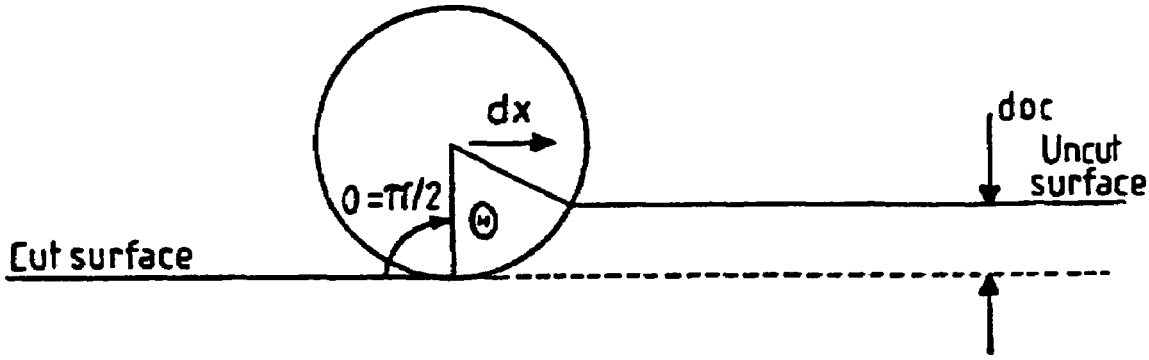
FIG. 4 depicts a grinding wheel and a flat surface that is to be ground.

Since $Q' \cdot dt = \int_{\Gamma} \overline{ds} \cdot \check{n}$, this can be re-written as:

$$Q' dt = wrac \cdot \int_0^{\vartheta} [\text{real}(\overline{dR}) + wrac \cdot \sin(\Psi - \Theta) d\Psi] \cdot \cos(\Psi - \Theta) d\Theta + \ldots + wrac \cdot \int_0^{\vartheta} [\text{imag}(d\overline{R}) - wrac \cdot \cos(\Psi - \Theta) d\Psi] \cdot \sin(\Psi - \Theta) d\Theta$$

i.e. $Q' dt = wrac \cdot \{\text{real}(d\overline{R}) \cdot [\sin(\Psi - \Theta) - \sin(\Psi)] - \text{imag}(d\overline{R}) \cdot [\cos(\psi - \Theta) - \cos(\Psi)]\} = \text{Equation(B)}$ If we now consider the simple case of a flat surface being ground by a cylindrical grinding wheel, as shown in FIG. 4, a simpler computation for Q' can be derived. Namely at each point along a flat surface:

Q'=v·doc (where v is contact velocity and doc is the depth of cut).

The derivation of this equation is shown in Formula 2 calculations as follows:

$$d\overline{R} = dx, \ \text{imag}(d\overline{R}) = 0$$

$$\Psi = \theta - \Phi = \pi/2$$

Using equation (B) above, $$Q' \cdot dt = wrac \cdot [\sin(\pi/2 - \Theta) - \sin(\pi/2)] \cdot dx$$

$$v = dx/dt, \text{ and } doc = wrac \cdot [1 - \sin(\pi/2 - \Theta)]$$

$$\text{ie. } Q' = v \cdot doc$$

Figure 5:
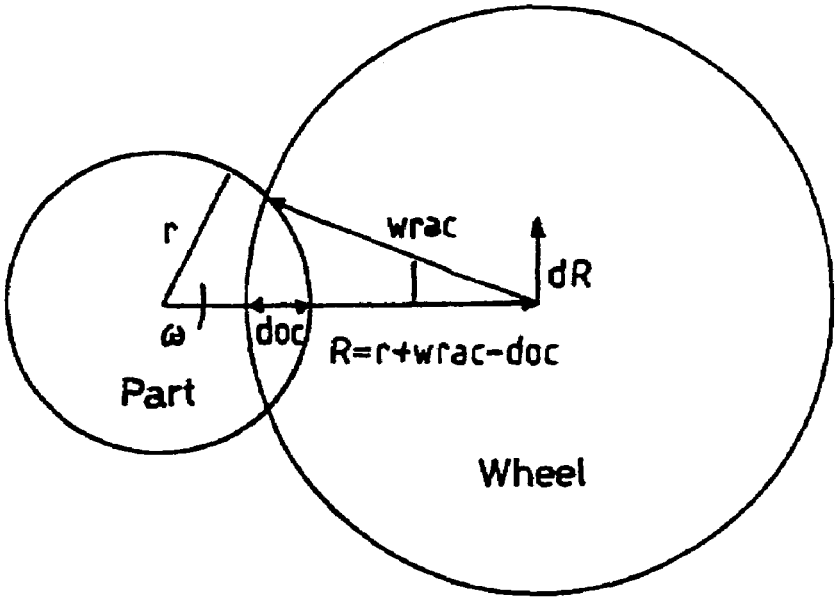
FIG. 5 depicts a grinding wheel and a cylindrical surface that is to be ground.

If we now consider a case where the surface of the component being ground is itself curved and has a radius r, as shown in FIG. 5, then the value for Q' can be considered to be the area enclosed by the uncut surface, less the area of the cut surface, multiplied by the rotary velocity.

The derivation of the value Q' in this example is demonstrated in the Formula 3 calculations as follows:

$$\omega = \frac{d\theta}{dt}$$

$$d\overline{R} = R \cdot [-\sin(\theta) + i \cdot \cos(\theta)] \cdot d\theta$$

For convenience, evaluate equation (B) at $\theta = \Phi = 0$ $$\text{Then } d\overline{R} = i \cdot (r + wrac - doc) \cdot d\theta$$

$$\Rightarrow Q' = wrac \cdot (r + wrac - doc) \cdot [1 - \cos(-\Theta)] \cdot \omega$$

Now, from the Law of Cosines $$\cos(-\Theta) = \frac{R^2 + wrac^2 - r^2}{2 \cdot R \cdot wrac}$$

substituting this identity for cos(−Θ) above $$Q' = \frac{1}{2}(2r - doc) \cdot doc \cdot \omega = \frac{1}{2} \cdot [r + (r - doc)][r - (r - doc)] \cdot \omega$$

$$= \frac{1}{2} \cdot [r^2 - (r - doc)^2] \cdot \omega$$

$$= \pi \cdot [r^2 - (r - doc)^2] \cdot rpm$$

which is the area enclosed by the uncut surface less the area of the cut surface multiplied by the rotary velocity If the cam flanks are flat, and merge with the curves at base at one end and the crown or lift at the other end, the value of Q' can be computed at each point using the appropriate approach depending on whether the surface is convexly curved or flat.

If a cam has concave features in the flanks the angle Θ cannot be known exactly except on the base circle and around the crown.

For points on the ramps, the angle may be found from a layout of the wheel, cut surface, and uncut surface.

A program may be written to perform this analysis using the Formula 4 calculations as follows:

$$Ø=\tan^{-1}[d(\text{lift})/\text{lift}\cdot d(\angle\text{lift})] \quad (C)$$

$$\overline{\text{lift}}=\text{lift}\cdot[\cos(\angle\text{lift})+i\cdot\sin(\angle\text{lift})] \quad (D)$$

$$\overline{R}=\overline{\text{lift}}+(\text{wrac}-\text{follower})\cdot[\cos(\angle\text{lift}-Ø)+i\cdot\sin(\angle\text{lift}-Ø)]$$

$$\Phi=\tan^{-1}[d|R|/|R|\cdot d\theta] \quad (F)$$

$$\overline{p}=\overline{R}-wrac\cdot[\cos(\theta-\Phi)+i\cdot\sin(\theta-\Phi)] \quad (G)$$

1) Calculate the angle of the surface normal on the pitch radius of the follower using equation (C).

Note: d(lift) can be accurately calculated using a central difference equation and d(∠lift) is normally π/180 for even degree lift tables.

2) Evaluate the lift figures in complex form using equation (D).

3) Calculate the pitch radius of the grinding wheel using equation (E).

4) Interpolate the pitch radius of the grinding wheel to the angle intervals of the work speed; usually at even degree intervals.

5) Calculate the angle of the surface normal on the pitch radius of the grinding wheel using equation (F).

6) Calculate the cam profile using equation (G).

7) Calculate the uncut cam profile using equation (H).

8) Determine the angle Θ by interpolating the point of intersection of the uncut surface and the grinding wheel using the points from step 7 and layouts of the grinding wheel about points from step 3.

(Note: the angle Θ can also be used to calculate the 'geometric' contact length 1, since 1=wrac·θ).

9) Calculate the time steps from the work speed using equation (I) from Formula 4.

10) Calculate Q' using values calculated from the above in equation (B).

Calculation of Θ is time consuming and in practice an approximation for Q' may be made using points on the cam profile from step 6 and the model of removal rate interpreted as if grinding a flat part i.e., Q'=v·doc where v is the footprint speed. The resulting simplified equation for deriving Q' is given by equation J of Formula 4.

Here again dp is preferably calculated using the central difference equation

I claim:

1. A method of grinding a component which is rotated by a headstock during grinding to finish size, wherein the method comprises linking the headstock velocity to the power capabilities of the grinding wheel spindle motor, and maintaining a significant grinding force between the wheel and the component from the beginning to the end of the grinding process, including during finish grinding to present a substantially constant loading on the spindle motor, which is very close to the maximum constant power rating of the motor, thereby to achieve a predetermined depth of cut even during the finish grinding step, for the purpose of reducing chatter and grind marks on the final finished surface and to achieve a short grind time.

2. A method of grinding a component which is rotated by a headstock during grinding wherein the method comprising controlling the head stock velocity during grinding to achieve a substantially constant power demand on the spindle drives, especially during final finish grinding so as to accelerate and decelerate the rotational speed of the component during grinding while maintaining a significant depth of cut, so as to present a substantially constant loading on the spindle motor, which is very close to the maximum power rating of the motor, for the purpose of achieving substantially even wear around the circumference of the grinding wheel and achieving a short grind time.

3. A method of grinding as claimed in claim 1 wherein the method comprises providing a component that is non-cylindrical and the headstock speed of rotation is altered as the component rotates to achieve a substantially constant load on the spindle drive motor.

4. A method of achieving substantially constant wear around the circumference of a grinding wheel when grinding a component which itself is rotated by a headstock and reducing grind and chatter marks on the component being ground, wherein the method comprises programming a computer to control headstock acceleration and deceleration and headstock velocity during the rotation of the component and to take into account any variation in contact length between the wheel and component during the rotation of the latter, so that although the metal removal rate may vary slightly around the circumference of the component the power demand on the spindle motor is maintained substantially constant during the whole of the grinding of the component.

5. A method of computer-controlled grinding of a component to produce a finish-ground article, comprising performing a first stage in which the wheel grinds the component to remove a relatively large depth of material while the component is rotated by a headstock around its axis, providing computer control of the headstock velocity at all times during each rotation of the component and with adjustment of the headstock velocity to accommodate any variation in contact length in any region around the component so as to maintain a substantially constant power demand on the grinding wheel spindle motor which is equal to or just below the maximum constant power rating of the motor, so that the time for the first stage is reduced to the shortest period in view of the power available, and performing a second stage in which the component is ground to finish size, with the grinding parameters and particularly wheelfeed and headstock velocity being computer controlled so that power demand on the spindle motor is maintained constant at or near the constant power rating of the motor at all points around the component during the second stage, and so that the depth of cut is such as to leave the component ground to size.

6. A method as claimed in claim 5, wherein the second stage involves a single revolution of the component, and the second stage is not begun until the depth of material left to be removed can be ground off in a single revolution of the component.

7. A method of grinding a component as claimed in claim 1 wherein achieving a substantially constant power demand on the spindle drive by controlling the headstock velocity during grinding, and by accelerating and decelerating the rotational speed of the component during grinding while maintaining a significant depth of cut, so as to present a substantially constant loading on the spindle motor, which is very close to the maximum power rating of the motor, for the purpose of achieving substantially even wear around the circumference of the grinding wheel.

8. The method of grinding a component as claimed in claim 7 wherein the method comprises controlling the headstock acceleration and deceleration and headstock velocity during the rotation of the component to take into account any variation in contact length between the wheel and component during the rotation of the latter, so that although the metal removal rate may vary slightly around the circumference of the component the power demand on the spindle motor is maintained substantially constant during the whole of the grinding of the component.

9. A method of grinding a component as claimed in claim 1 in which the grinding is performed using a small diameter wheel, both for rough grinding and for finish grinding, so as to reduce the length of contact between the grinding wheel and the component, for the purpose of allowing coolant fluid to have good access to the region in which grinding is occurring at all stages of the grinding process, so as to minimize surface damage which can otherwise occur if coolant fluid is obscured from the component.

10. A method as claimed in claim 9 wherein the grinding is performed using two small wheels mounted on the same machine and one is used to rough grind and the other to finish grind the component, without the need to demount the latter.

11. A method as claimed in claim 9 wherein the method comprises providing a single wheel capable of rough grinding and finish grinding the component.

12. A method as claimed in claim 9 in which the grinding wheel is a CBN wheel.

13. A method of grinding a component as claimed in claimed 8 to produce a finish-ground article, comprising a first stage in which the wheel grinds the component to remove a relatively large depth of material while the component is rotated by a headstock around its axis, so that the time for the first stage is reduced to the shortest period in view of the power available, and further comprising a second stage in which the component is ground to finish size, with the grinding parameters and particularly wheel-feed and headstock velocity being controlled so that power demand on the spindle motor is maintained constant at or near the constant power rating of the motor at all points around the component during the second stage, and so that the depth of cut of the second stage is such as to leave the component ground to size.

14. A method as claimed in claim 13, wherein the second stage involves a single revolution of the component, and the second stage is not begun until the depth of material left to be removed can be ground off in a single revolution of the component.

* * * * *

UNITED STATES PATENT AND TRADEMARK OFFICE

CERTIFICATE OF CORRECTION

PATENT NO. : 7,297,046 B2
APPLICATION NO. : 10/936167
DATED : November 20, 2007
INVENTOR(S) : Mavro-Michaelis It is certified that error appears in the above-identified patent and that said Letters Patent is hereby corrected as shown below:

Column 1, line 29 delete "m" and insert therein --mm--
Column 11, line 29 delete "along θ" and insert therein --along Γ--
Claim 2, Column 14, line 8 delete "drives" and insert therein --drive--
Claim 2, Column 14, line 6 delete "head stock" and insert therein --headstock--
Claim 7, Column 14, line 63 delete "wherein" and insert therein --comprising--

Signed and Sealed this

Twenty-second Day of December, 2009

David J. Kappos

David J. Kappos
*Director of the United States Patent and Trademark Office*